US009200358B2

(12) United States Patent
Zuber et al.

(10) Patent No.: US 9,200,358 B2
(45) Date of Patent: Dec. 1, 2015

(54) MANUFACTURING PROCESS OF A STRUCTURAL COMPONENT FOR A MOTOR VEHICLE, PLATE BAR FOR HOT FORMING AND STRUCTURAL COMPONENT

(75) Inventors: Armin Zuber, Bad Lippspringe (DE); Andreas Frehn, Delbrueck (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 0 days.

(21) Appl. No.: 12/925,169

(22) Filed: Oct. 14, 2010

(65) Prior Publication Data

US 2011/0120596 A1 May 26, 2011

(30) Foreign Application Priority Data

Oct. 14, 2009 (DE) ..... 10 2009 049 398

(51) Int. Cl.

| | |
|---|---|
| ***B21D 22/20*** | (2006.01) |
| ***B21D 53/88*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |
| ***C22C 38/20*** | (2006.01) |
| ***C22C 38/28*** | (2006.01) |
| ***C22C 38/32*** | (2006.01) |
| ***C23C 8/38*** | (2006.01) |
| ***B21J 5/02*** | (2006.01) |
| ***C23C 8/02*** | (2006.01) |
| ***C23C 8/36*** | (2006.01) |
| ***C23C 8/80*** | (2006.01) |

(52) U.S. Cl.

CPC . *C23C 8/38* (2013.01); *B21D 53/88* (2013.01); *B21J 5/02* (2013.01); *C23C 8/02* (2013.01); *C23C 8/36* (2013.01); *C23C 8/80* (2013.01); *Y10T 29/49622* (2015.01)

(58) Field of Classification Search

None

See application file for complete search history.

(56) References Cited

U.S. PATENT DOCUMENTS

| | | | | |
|---|---|---|---|---|
| 2007/0119519 | A1 * | 5/2007 | Okonogi et al. | 148/226 |
| 2009/0242086 | A1 | 10/2009 | Thomas et al. | |

FOREIGN PATENT DOCUMENTS

| | | | | |
|---|---|---|---|---|
| DE | 10150093 | C1 | 8/2002 | |
| DE | 103 50 885 | B4 | 7/2008 | |
| DE | 102008060161 | A1 | 6/2010 | |
| FR | 2939148 | A1 | 6/2010 | |
| JP | 06-172867 | * | 6/1994 | C21D 9/32 |
| JP | 2004-183006 | * | 7/2004 | C22C 38/00 |
| JP | 2005133180 | A | 5/2005 | |
| JP | 2005200670 | A | 7/2005 | |
| JP | 2005342742 | A | 12/2005 | |
| JP | 2006224162 | A | 8/2006 | |
| JP | 2006522221 | A | 9/2006 | |
| JP | 2007332417 | A | 12/2007 | |

OTHER PUBLICATIONS

English Translation of Kojima et al (JP 2004-183006).*
English Translaton of Uno et al (JP 06-172867).*
Marder, Effects of Surface Treatments on Materials Performance, ASM (2002).*
Ruuki Boron Steel 22MnB5 (http://www.ruukki.com/Products-and-solutions/Steel-products/Cold-rolled-steels/Hardenable-steels/Boron-steel-22MnB5).*
Docol 22MnB5 Data Sheet: May 24, 2011 GB8227DOCOL (http://www.ssab.com/Global/DOCOL/datasheets_docol/en/227_Docol_22MnB5_Cold_rolled_boron_steel_for_hardening_in_water_or_oil.pdf).*
Kolleck, Press Hardening Process of Boron Steel Sheets, Auto Focus Asia (Sep. 2008).*
Din EN 10027-1 entitled "Designation systems for steels," published Oct. 2005.

* cited by examiner

*Primary Examiner* — Yoshitoshi Takeuchi
(74) *Attorney, Agent, or Firm* — Kriegsman & Kriegsman

(57) ABSTRACT

The present invention relates to a manufacturing process of a structural component for a motor vehicle, wherein a plate bar is heated, is fed to a die in the heated state and is shaped in the die. The process is characterized in that the plate bar is subjected to a nitriding process before the shaping. Furthermore, a plate bar for hot-forming for manufacturing a structural component for a motor vehicle is described, wherein the surface of the plate bar has a nitrided layer. Finally, the present invention relates to a structural component of a motor vehicle, which is manufactured by hot forming from a plate bar having a nitrided layer.

5 Claims, No Drawings

MANUFACTURING PROCESS OF A STRUCTURAL COMPONENT FOR A MOTOR VEHICLE, PLATE BAR FOR HOT FORMING AND STRUCTURAL COMPONENT

The present invention relates to a manufacturing process of a structural component for a motor vehicle, a plate bar for the hot forming as well as to a structural component for a motor vehicle.

For manufacturing of structural components for the automobile body or a chassis of a motor vehicle either a cold forming process or a hot forming process can be used. The advantage of a hot forming process, wherein the plate bar, which is to be shaped, is heated to austenitizing temperature and is subsequently shaped in a die, is the increased strength, which can be achieved compared to cold formed structural components. In addition, with hot forming of the structural component the springback is lower compared to the springback with cold forming and thus the accuracy of dimensions is higher.

However, when using conventional plates consists of heat-treatable material disadvantages exist with the hot forming. The plate bar has to be transported to the die after the treatment in the furnace. If this transport is not performed under protective gas but under normal atmosphere, the formation of a scale layer on the plate will occur due to the contact with air. For forming or shaping processes in dies, the scale layer will then act like an abrasive medium and thus increases the tool wear. This results in increased tool maintenance costs and potentially in increased discard. In addition, the component will subsequently have to be blasted, as the scale counteracts to lacquering.

For preventing scale formation, in DE 103 50 885 B4, for example, coating of a plate bar, in particular hot-dip aluminizing of a plate bar, is described. One disadvantage of this coating is that it does not represent a real corrosion protection but merely offers a good precondition for a subsequent lacquering of the press-hardened components.

A further problem is that the temperature for austenitizing in the furnace has to be adjusted such that it is always below the melting point of the coating. The melting point of the coating, however, permanently changes at higher temperatures, so that the requirements as to the temperature control are increased.

The object of the present invention is thus to provide a possibility for manufacturing a structural component for a motor vehicle, wherein with low tool wear structural components with good component quality can be provided in an easy way.

The invention is based on the finding that this object can be achieved by subjecting the plate bar to surface treatment before the hot forming.

In this context, surface treatment is understood to be a thermo-chemical treatment of the plate bar. In particular, a treatment of the plate bar is employed as surface treatment, wherein the plate bar is exposed to a gas, so that the properties of the surface of the plate bar change. In contrast to a coating, where a coating material is applied to the surface, the surface treatment effects a change in the surface of the plate bar itself.

According to a first aspect, the present invention thus relates to a process for manufacturing a structural component for a motor vehicle, wherein a plate bar is heated, is fed to a die in the heated state and is shaped in the die. The method is characterized in that the plate bar is subjected to a nitriding process prior to the shaping in the die.

Components of the automobile body or the chassis of a motor vehicle, which may absorb impact energy in the event of a crash, are referred to as structural components. These structural components differ from other chassis components, which have to resist dynamic load, which arises from the movement of the motor vehicle. In contrast, structural components inter alia serve for converting impact energy into deformation energy in case of an impact of a motor vehicle with a different object. Structural components of motor vehicles are for example bumpers, motor hoods, side impact protection components, A-, B- and C-pillars.

According to the present invention, a sheet-metal plate, which is cut from a coil or from a sheet-metal for the further processing, is considered to be a plate bar. In particular, a plate bar is punched or cut out of a sheet-metal. The plate bar may herein have a constant material thickness over the area. It is, however, also possible to use a plate bar having different material thicknesses.

The plate is preferably heated in a furnace. Heating, according to the present invention is preferably understood to be an increasing of the temperature of the plate bar to a temperature, which is above the austenitizing temperature Ac1 of the material of the plate bar. The die, to which the plate is fed in the heated state, that means after the heating in the furnace, is preferably a press tool, which may be cooled. The shaping in the die is also referred to as hot forming. The cooling in the die is preferably sufficiently fast, to form a martensitic structure. In case of cooling of the plate bar in the die, the shaping in the die is also referred to as press hardening.

The strength of a structural component manufactured by hot forming, in particular by press hardening, can be increased compared to structural components, which are manufactured by cold forming of so called cold forming steels. Hence, a reduction of the material thickness of the structural component becomes possible and thereby the potential for weight-saving constructions is provided. A further advantage compared to cold forming is in addition the reduced springback of the structural component after the forming.

Surprisingly, it has been found that a surface treatment, in particular a surface hardening of the plate bar by nitriding, in such a manufacturing process with heating and subsequent shaping of the heated plate bar provides unexpected advantages relating to the manufacturing process and the component quality.

The nitriding process, which hereinafter will also be referred to as nitriding, comprises exposing the plate bar to nitrogen-containing gas or to a different nitrogen-containing medium. The nitriding treatment can be carried out in a chamber furnace or in a continuous furnace. By means of the nitriding of the plate bar, a very hard superficial compound layer is formed at the surfaces of the plate bar by nitrogen diffusing into it. Underneath the compound layer a so called diffusion zone is formed, wherein the nitrogen is included up to a certain depth within the metal matrix of the basic structure, for example the ferritic metal matrix. It is, however, also possible to nitride the plate bar such that the forming of a compound layer is prevented.

Nitriding is normally carried out at temperatures of 400° C.-600° C. In addition, generally nitriding is carried out under vacuum, so that a plate bar surface free of oxides is formed and thus a subsequent blasting treatment of the surfaces prior to the lacquering treatment can be omitted. This results in the shortening of the process chain and thus in an optimization of costs. The nitriding layer furthermore prevents scaling during the transport of the plate bar to the die and thus reduces tool wear. In addition, a potential additional corrosion protection coating is unnecessary, as the nitrided layer is already sufficiently corrosion resistant.

According to the present invention, the nitriding of the plate bar can for example be performed by gas nitriding or plasma nitriding, which is also referred to as ionitriding. A specific advantage of the plasma nitriding and gas nitriding is that an aftertreatment of the nitrided plate bar is not necessary. Thereby, a further optimizing of the process compared to processes such as bath nitriding can be achieved.

According to the present invention, plasma nitriding is preferred, as thereby the treatment time during nitriding can be shortened. With plasma nitriding, the nitriding of the plate bar is performed in an ionized gas atmosphere.

Preferably, a typical nitrided layer is applied on the surfaces of the plate bar or is formed in the surfaces, respectively, by means of plasma nitriding before shaping the plate bar. The nitrided layer is characterized by a particular corrosion resistance, scaling-resistance and workability.

According to the present invention, the nitriding process is carried out before the shaping of the plate bar. According to one embodiment, the nitriding process is carried out before the introduction of the plate bar to the furnace. Alternatively, it is, however, also possible that the plate bar is fed to the nitriding process after the heating to austenitizing temperature.

The shaped plate bar according to the invention may be introduced to the final processing immediately after the hot forming. This immediate final processing may for example be the lacquering of the structural component. Such an immediate final processing after hot forming is possible with the inventive process, as scaling does not occur during the transport of the plate bar to the die or in the die. A blasting of the structural components after shaping may therefore be omitted with the process according to the invention. Also the application of a corrosion layer is not necessary with the process according to the invention. The diffusion layer and potentially compound layer which form during nitriding also prevent corrosion after the shaping. Therefore, the number of required processing steps in the manufacturing process is minimized.

The plate bar, which is used with the process according to the invention, may consist of a heat-treatment steel. It has shown, that also with these steels a sufficient protection against scaling and corrosion can be achieved by nitriding. Also the use of micro-alloyed steel as material for the plate bar, which is shaped according to the inventive process into a structural component, is possible. A further potential material of which the plate bar may be made is 22MnB5 steel alloy.

present, whereby the workability, in particular the weldability, of the final product remains possible.

According to one embodiment, the process according to the invention is a continuous process. A continuous process in this context is to be understood as a process for series production of structural components, wherein the cycle times of the individual processing steps are mutually adapted. Herein, the manufacturing process is integrated as a production chain, such that the products, which have completed one process step, are immediately forwarded to the next treatment step. The advantage of this process lays in the cost optimizing, which exists due to the fact that the requirement of long intermediate storage is removed. Furthermore, the cycle time of the manufacturing process, which is used with conventional manufacturing processes of structural components, does not have to be prolonged due to the short treatment duration of the nitriding. The nitriding, in particular the plasma nitriding, may rather be included into the manufacturing process without changing the cycle times.

According to a further aspect, the present invention relates to a plate bar for hot forming for manufacturing a structural component for a motor vehicle. The plate bar is characterized in that the surface of the plate bar has a nitrided layer. By using such a plate bar in the hot forming, in particular in press hardening, scaling of the plate can be prevented.

The plate bar according to the invention may be made of micro-alloyed steel or heat-treatment steel. The plate bar may for example consist of a 22MnB5 steel. Thereby, the costs for manufacturing of the plate bar are minimized.

Preferably, the plate bar is a plate bar for manufacturing a bumper, a motor hood, a side impact protection component or an A-, B- or C-pillar.

According to a further aspect, the invention relates to a structural component for a motor vehicle, which is characterized in that it is manufactured by the manufacturing process according to the invention. In particular, the structural component is made from a surface treated, in particular nitrided, plate bar.

A steel of which the plate bar for the process according to the invention and the plate bar according to the invention, respectively, may consist is for example the heat-treatment steel distributed by the company Benteler AG under the trade name BTR 165.

Besides iron and contaminants due to smelting, the steel which is used as starting material may for example have one of the three distributions of alloying elements in weight percent as shown in table 1.

TABLE 1

| | C | Si | Mn | P | S | Al | B | Cr | Ti | Mo | Cu | Ni |
|---|---|---|---|---|---|---|---|---|---|---|---|---|
| 1 | 0.18-0.3 | 0.1-0.7 | 1.0-2.5 | Max. 0.025 | Max. 0.01 | 0.01-0.06 | 0.0015-0.005 | Max. 0.8 | 0.02-0.05 | Max. 0.5 | — | — |
| 2 | 0.23-0.27 | 0.15-0.50 | 1.10-1.40 | Max. 0.025 | Max. 0.01 | 0.02-0.06 | — | 0.10-0.35 | 0.03-0.05 | 0-0.35 | — | — |
| 3 | 0.22-0.25 | 0.20-0.30 | 1.20-1.40 | Max. 0.020 | Max. 0.010 | 0.02-0.06 | 0.0020-0.0035 | 0.10-0.20 | 0.020-0.050 | Max. 0.35 | Max. 0.10 | Max. 0.30 |

As conventional steels may be used in the inventive process or may be used as material for the inventive plate bar, the manufacturing costs of a structural component are not negatively influenced. Furthermore, these materials in comparison to nitriding steels have the advantage that their manufacturing costs are lower and in addition a lower carbon content is According to one embodiment, the plate bar consists of a steel, which in weight percent consists of:

Carbon (C): 0.22% to 0.25%

Silicon (Si): 0.10% to 0.50%

Manganese (Mn): 1.00% to 2.50%

Phosphor (P): max. 0.025%

Sulphur (S): max. 0.010%
Aluminium (Al): 0.010% to 0.060%
Boron (B): 0.0015% to 0.005%
Chromium (Cr): 0.10% to 0.80%
Titanium (Ti): 0.020% to 0.050%
Molybdenum (Mo): max. 0.50%
Copper (Cu): max. 0.10%
Nickel (Ni): max. 0.30%
Rest: Iron and contaminants due to smelting.

It has proven that with those alloys respectively a hardening of the surface during nitriding can be achieved, which offers, in particular for structural components of a motor vehicle, a sufficient scaling protection and corrosion protection. Furthermore, the steel alloy can be manufactured at low prices and, in particular due to the low carbon content, can be welded.

It should be noted that in contrast to the indicated alloy composition, the nitride formers (Al, Ti, V, Mo, Cr) each can be alloyed individually or in combination with one another. The mentioned steel alloys, which can be used in the process of the invention, are in particular characterized by the low carbon content, by the nitride formers (Al, Ti, V, Mo, Cr) contained in the respective alloy in suitable amounts, by the good workability of the steel, which has these compositions, as well as by the low price of the steel and finally by the availability of the starting materials.

Advantages and features which are described with respect to the process, are also valid—as far as applicable—for the sheet plate of the invention and the structural component of the invention and vice versa. Furthermore, the advantages and features, which are described with respect to one embodiment, are also valid for other embodiments without requiring these to have all features of the respective other embodiment.

The present invention has a number of advantages. Firstly, the tool wear is reduced as the scale formation due to the nitrided layer does not occur during the transport to the die. Furthermore, a constant component quality can be provided, as the shape of the structural component is achieved by hot forming and the springback is thus reduced compared to cold formed structural components. Furthermore, the discard is minimized and the costs are reduced by the reduction in process steps, for example the omission of a blasting treatment of the component before lacquering. Furthermore, other corrosion protection systems may be omitted.

The invention claimed is:

1. Manufacturing process of a structural component for a motor vehicle, wherein said method comprises:

heating a plate bar, feeding the heated plate bar into a die, wherein the temperature of the heated plate bar at the time it is fed into the die is above the $A_{cl}$ temperature, shaping the heated plate bar in the die, and cooling the heated plate bar in the die sufficiently fast to form a martensitic structure in at least some regions of the final product, characterized in that before shaping, the plate bar is subjected to a nitriding process, and in that the plate bar is made of a steel, which in weight percent consists of:

carbon—0.22% to 0.25%;
silicon—0.10% to 0.50%;
manganese—1.00% to 2.50%;
phosphorus—max. 0.025%;
sulphur—max. 0.010%;
aluminium—0.010% to 0.060%;
boron—0.0015% to 0.005%;
chromium—0.10% to 0.80%;
titanium—0.020% to 0.050%;
molybdenum—max. 0.50%;
copper—max. 0.10%;
nickel—max. 0.30%; and
rest—iron and contaminants due to smelting.

2. Manufacturing process according to claim 1, characterized in that the nitriding process is plasma nitriding.

3. Manufacturing process according to claim 1, characterized in that the nitriding process is carried out before the feeding of the plate bar to the furnace.

4. Manufacturing process according to claim 1, characterized in that the shaped plate bar is introduced to final processing after shaping and cooling in the die without intervening steps.

5. Manufacturing process according to claim 1, characterized in that the process is a continuous process.

* * * * *